US007543864B2

(12) United States Patent
Barthel

(10) Patent No.: US 7,543,864 B2
(45) Date of Patent: Jun. 9, 2009

(54) METHOD AND APPARATUS FOR REPAIRING A JAMB OF A DOOR OR WINDOW

(76) Inventor: Philip E. Barthel, 2909 Norway Pine Rd., Rockford, IL (US) 61109

( * ) Notice: Subject to any disclaimer, the term of this patent is extended or adjusted under 35 U.S.C. 154(b) by 103 days.

(21) Appl. No.: 11/411,526

(22) Filed: Apr. 26, 2006

(65) Prior Publication Data

US 2006/0260206 A1 Nov. 23, 2006

Related U.S. Application Data

(60) Provisional application No. 60/676,330, filed on Apr. 29, 2005.

(51) Int. Cl.
*E05B 15/02* (2006.01)

(52) U.S. Cl. ..... 292/340; 49/504; 52/211

(58) Field of Classification Search ..... 292/346, 292/340, 341, 341.14; 49/504–506; 52/211
See application file for complete search history.

(56) References Cited

U.S. PATENT DOCUMENTS 3,764,173 A 10/1973 Griffith
4,171,836 A * 10/1979 St. Aubin ..... 292/341.18
4,174,862 A * 11/1979 Shane ..... 292/346
4,295,299 A * 10/1981 Nelson ..... 49/504
4,474,394 A * 10/1984 Crepinsek ..... 292/340
4,717,185 A * 1/1988 Hartley ..... 292/340
4,809,400 A * 3/1989 Allen ..... 16/82
4,854,621 A * 8/1989 Baldwin ..... 292/340
4,858,384 A 8/1989 Blankenship
5,076,626 A 12/1991 Tiddy et al.
5,566,995 A * 10/1996 Jagiela ..... 292/346
6,598,350 B1 * 7/2003 Suter ..... 49/506
6,651,390 B2 11/2003 Camperelli

FOREIGN PATENT DOCUMENTS

GB 2 265 664 11/1995

* cited by examiner

*Primary Examiner*—Gary Estremsky
(74) *Attorney, Agent, or Firm*—Reinhart Boerner Van Deuren P.C.

(57) ABSTRACT

A method and apparatus are provided for repairing the jamb of a door, window, or the like, without removal or replacement of the jamb, through use of an elongated U-shaped channel adapted to slide over a portion of the jamb and be secured in place on the jamb. The channel includes slots therein for receipt of a latching mechanism where required.

1 Claim, 10 Drawing Sheets

METHOD AND APPARATUS FOR REPAIRING A JAMB OF A DOOR OR WINDOW

CROSS-REFERENCE TO RELATED PATENT APPLICATIONS

This patent application claims the benefit of U.S. Provisional Patent Application No. 60/676,330, filed Apr. 29, 2005.

FIELD OF THE INVENTION

This invention relates to jambs of doors, and windows, and the like, and more particularly to repairing such jambs.

BACKGROUND OF THE INVENTION

As shown in FIGS. 1 and 2, windows, doors, medicine cabinets, and the like, typically include an outer frame, commonly known as a jamb 100, which is installed into a rough opening 102 and a wall 103, by installing a pair of wedge-shaped shims 104 between the outside of the jamb 100 and the inner surface of the rough opening 102, and driving one or more finishing nails 106 through the jamb 100 and shims 104, and into the structural framing 101 of the wall 103 that defines the rough opening 102. This process leaves a gap 108 between the jamb 100 and the rough opening 102 that is typically covered, on one or both sides of the wall with several pieces of carpentry trim, that are individually and collectively known as window or door casing 110. The gap 108 is necessitated by the fact that the rough openings 102 are generally not square and plumb or closely dimensioned enough to eliminate the gap 108.

After doors, windows, and the like are installed, their jambs 100 sometimes sag, warp, or are otherwise damaged in a manner that severely affects the aesthetic appearance, or the proper performance of the jamb 100. In the past, such sagging, warping, or damage has typically necessitated removal and replacement of the jamb 100, a process that is undesirably complex and costly.

For example, where a door is "kicked in" during a forced entry, an elongated chunk 112 of the jamb, extending on either side of a door latch striker plate 114 is typically broken out of the door jamb 100, as illustrated in FIG. 3. As shown in FIG. 2, the door jamb 100 typically includes a hole 116 or recess machined therein, for receipt of a portion of the latch strike plate 114 and the door latch 118. Cutting the hole or recess for the latch striker plate 114 and latch 118 weakens the jamb significantly in the area of the latch, and leaves only a narrow section 120 of the jamb 100 available for resisting the force of an intruder attempting to kick-in or otherwise gain forced entry through the door.

In the past, where a door jamb 100 has been broken, as illustrated in FIG. 3, it has typically been necessary to remove and replace at least the door jamb 100, and in some instances the entire assembly of the door jamb 100 and the door. In order to remove and replace the door jamb 100, it is necessary to remove all of the door trim or casing 110 on both sides of the wall 103, resulting in a complex and costly, and time consuming operation. The aggravation and distress that is caused for occupants of the building with the broken door jamb is exacerbated by the fact that the door cannot be latched and secured until the necessary repairs are completed. Where this delay extends to a period of hours or days, while repair parts and competent repair personnel are located and brought in to complete the repair, the occupants and contents of the space closed by the door are left unsecured and vulnerable.

It is desirable, therefore, to provide a method and apparatus for effectively and efficiently repairing the jambs of doors, windows, and the like, quickly, and at minimum expense, without the need for removal and replacement of any portion of the jamb 100.

BRIEF SUMMARY OF THE INVENTION

The invention provides a method and apparatus for repairing the jamb of a door, window, or the like, without removal and replacement of the jamb through use of an elongated U-shaped channel, adapted to slide over a portion of the jamb and be secured in place on the jamb. The U-shaped channel may be formed from any appropriate material, such as metal, plastic, or composite materials. The channel may be secured in place by fasteners, such as screws and/or nails, and/or through use of an adhesive.

In some forms of the invention, a channel, according to the invention, includes a first and second leg thereof joined by a U-shaped bight. One or both of the legs of the channel may include slots or holes therein for receipt of a door latch. The legs of the channel may also include aligned through-holes therein, for passage of fasteners to anchor the channel to the door jamb and/or structural members forming the rough opening.

In some forms of the invention, a channel according to the invention is further utilized for replacing a latch strike plate. A channel, according to the invention, may also be adapted for reattachment of the strike plate as part of repairing the jamb.

A channel, according to the invention, may include two or more holes and/or elongated slots for receipt therein of latching and locking components of both a latch attached directly to a door handle, and a separate latch of a deadbolt lock.

In some forms of the invention, a channel, according to the invention, is formed from a material that is decorative, or coated to provide a pleasing aesthetic appearance, or resistance to degradation by environmental factors. The channel may also be adapted for receiving a coat of paint, or other decorative covering, for matching the finish of the door jamb.

The invention may be practiced in a variety of forms, including an apparatus for repairing a jamb, a method for repairing a jamb, or a method for fabricating an apparatus for repairing a jamb. An apparatus, according to the invention, may include a channel, according to the invention, or take the form of a repair kit including a channel, according to the invention, and instructions and/or fasteners required for installing the channel on the jamb.

Other aspects, objectives and advantages of the invention will be apparent from the following detailed description and the accompanying drawings.

BRIEF DESCRIPTION OF THE DRAWINGS

FIGS. 1-3 are representations of a prior art door jamb and latch assembly, and the damage to the jamb which sometimes occurs when the door is kicked-in.

FIGS. 9A and 9B illustrate the manner in which the invention may be utilized for repairing a sagging section of a jamb of a door, a window, or the like.

While the invention will be described in connection with certain preferred embodiments, there is no intent to limit it to those embodiments. On the contrary, the intent is to cover all alternatives, modifications and equivalents included within the spirit and scope of the invention.

DETAILED DESCRIPTION OF THE INVENTION

Figure 1:
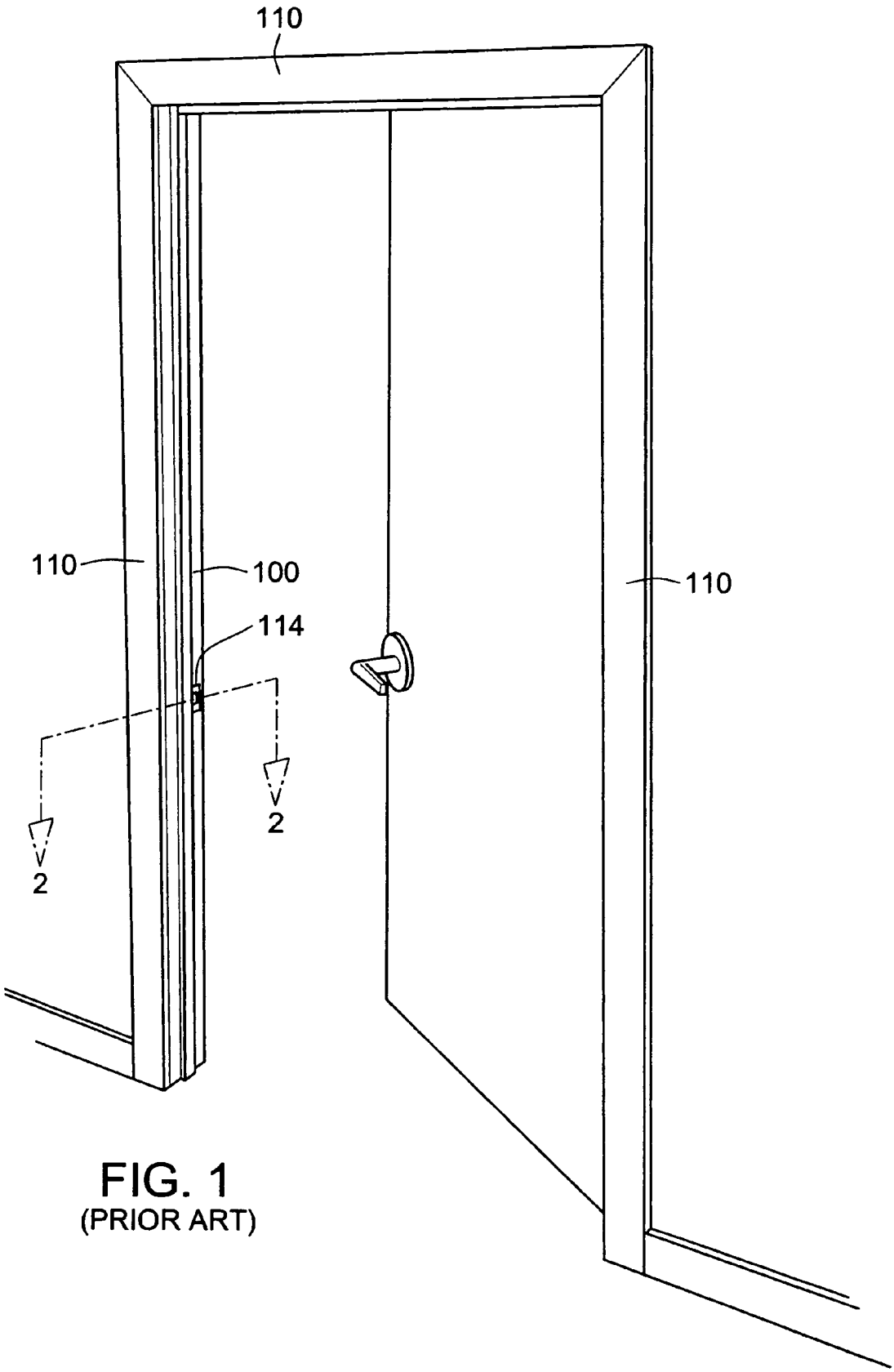
FIG. 1 (PRIOR ART)
Figure 2:
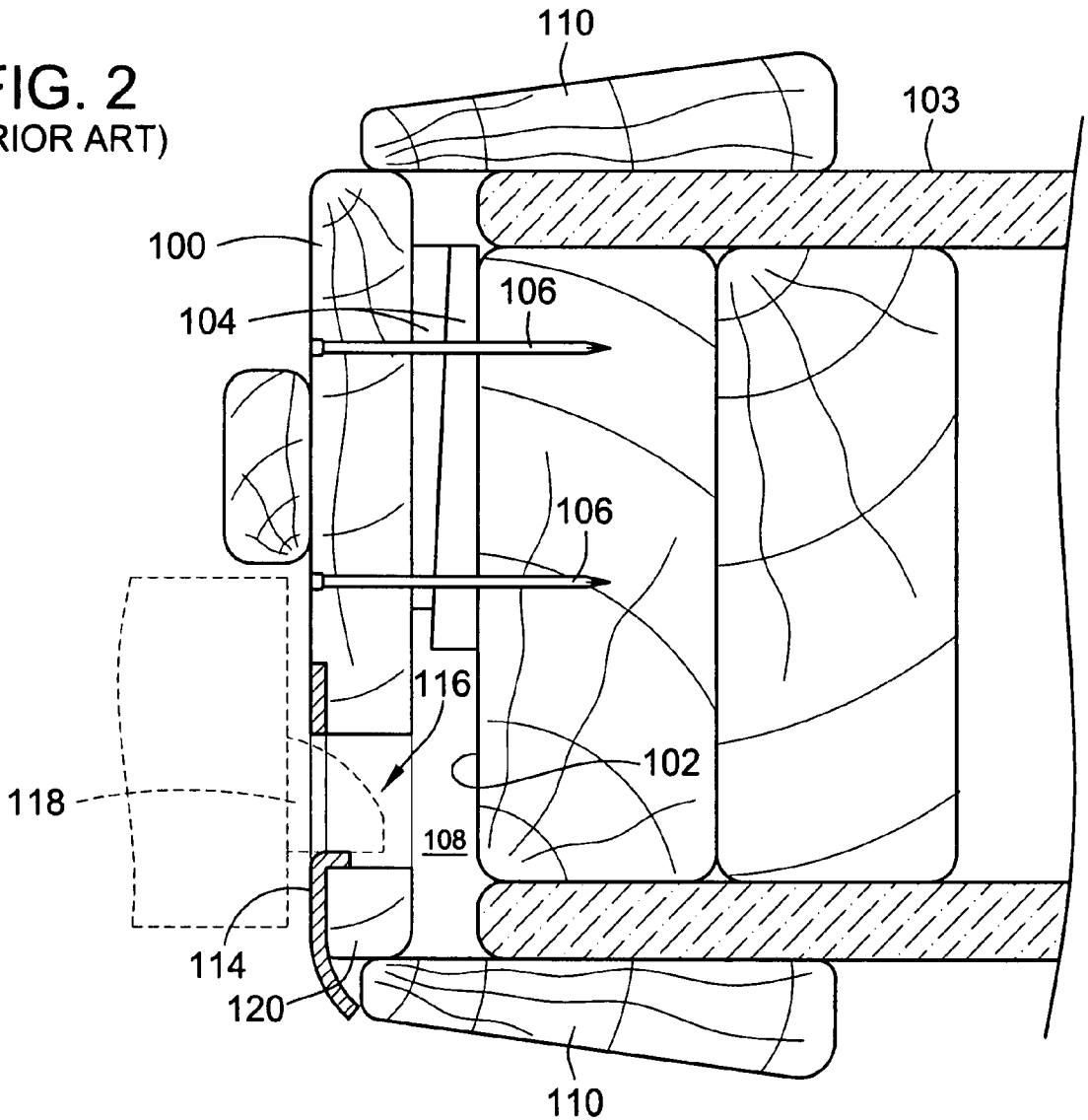
FIG. 2 (PRIOR ART)
Figure 3:
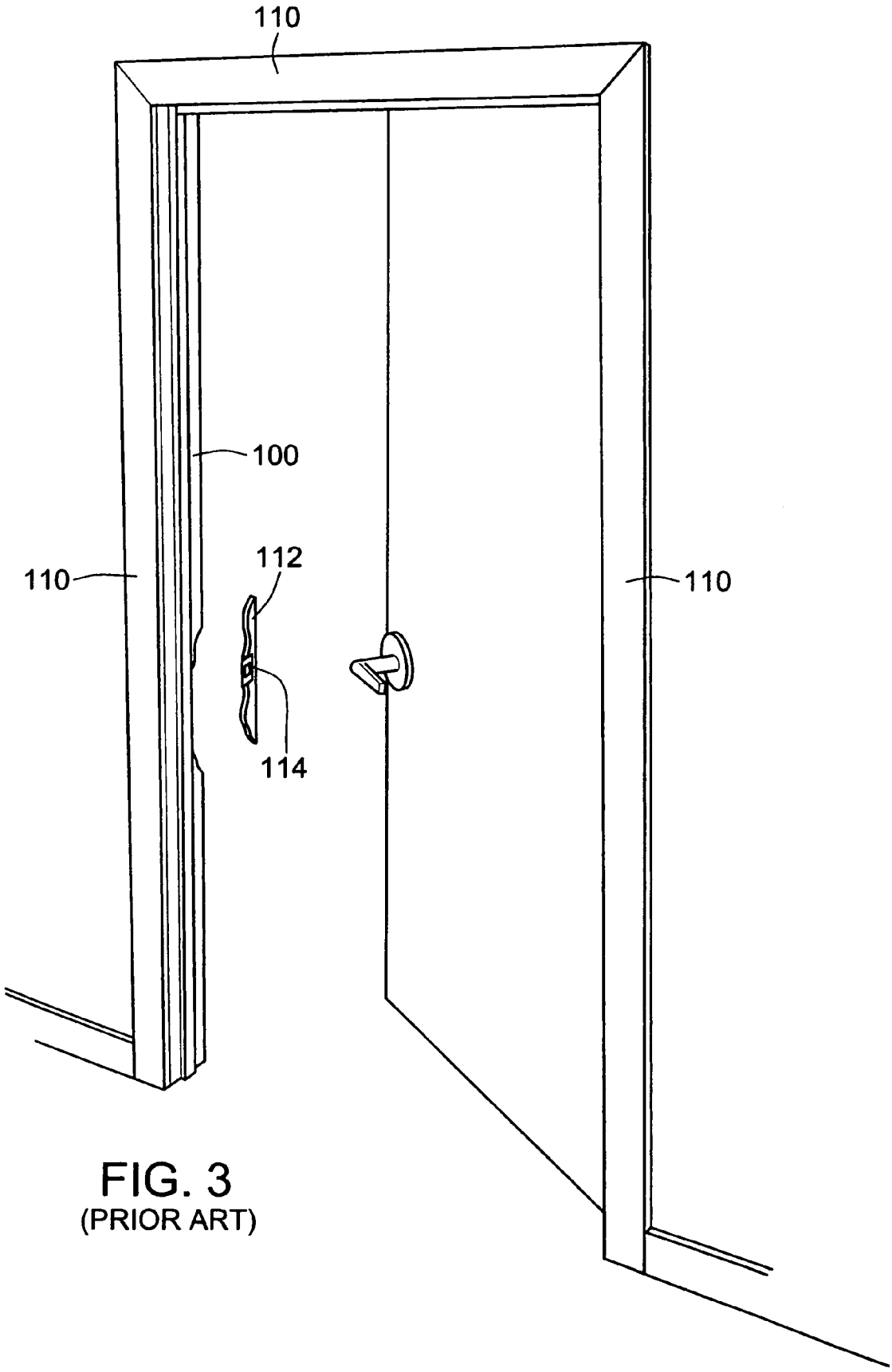
FIG. 3 (PRIOR ART)
Figure 4:
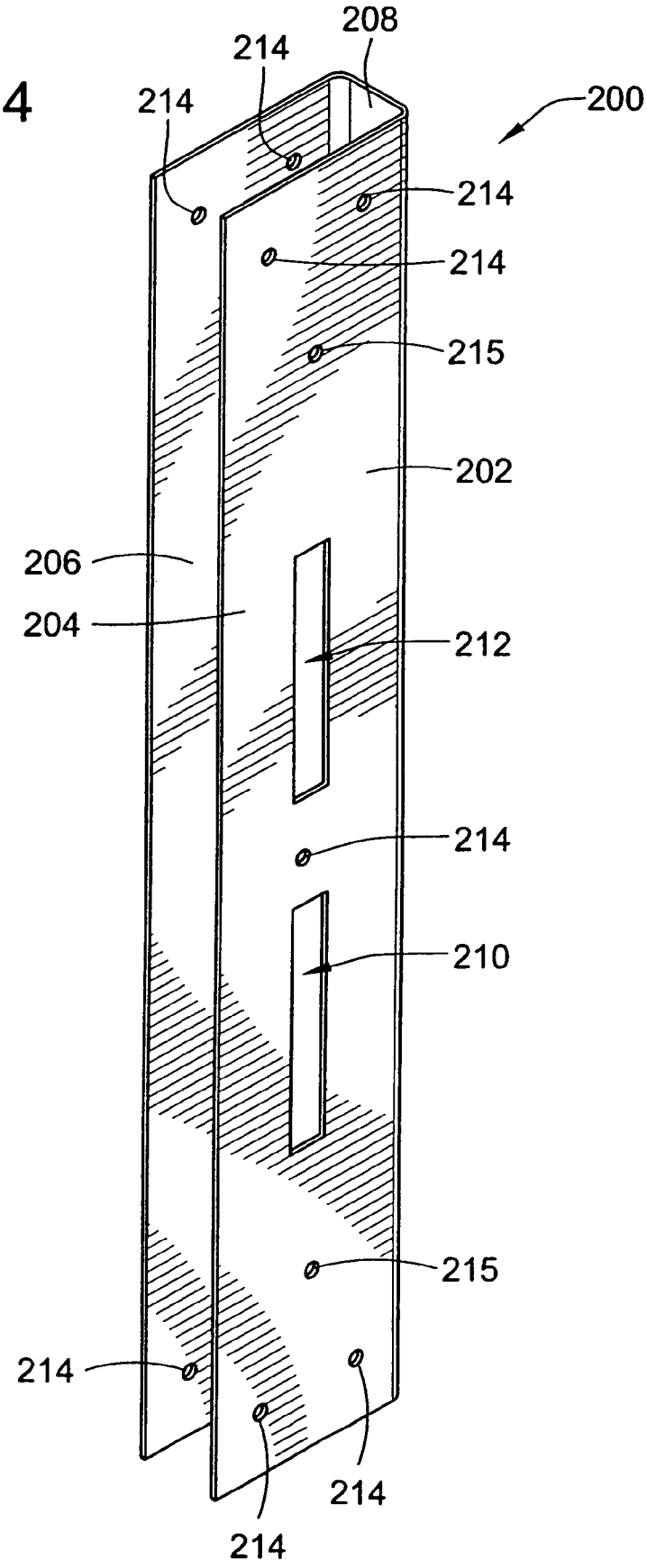
FIGS. 4-7 illustrate the manner in which the invention may be utilized for repairing the damage to door jamb of FIGS. 1-3.
Figure 5:
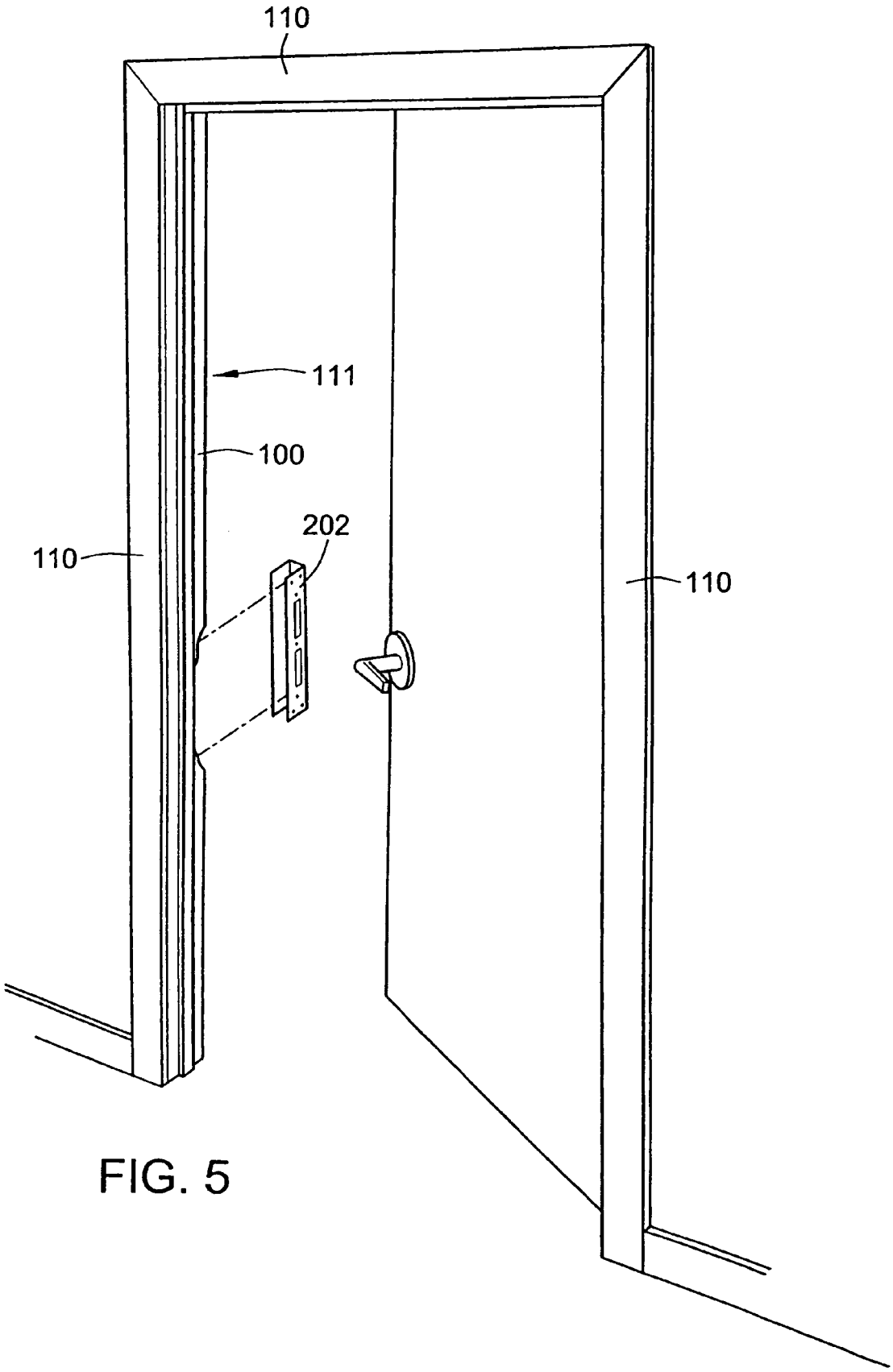
Figure 6:
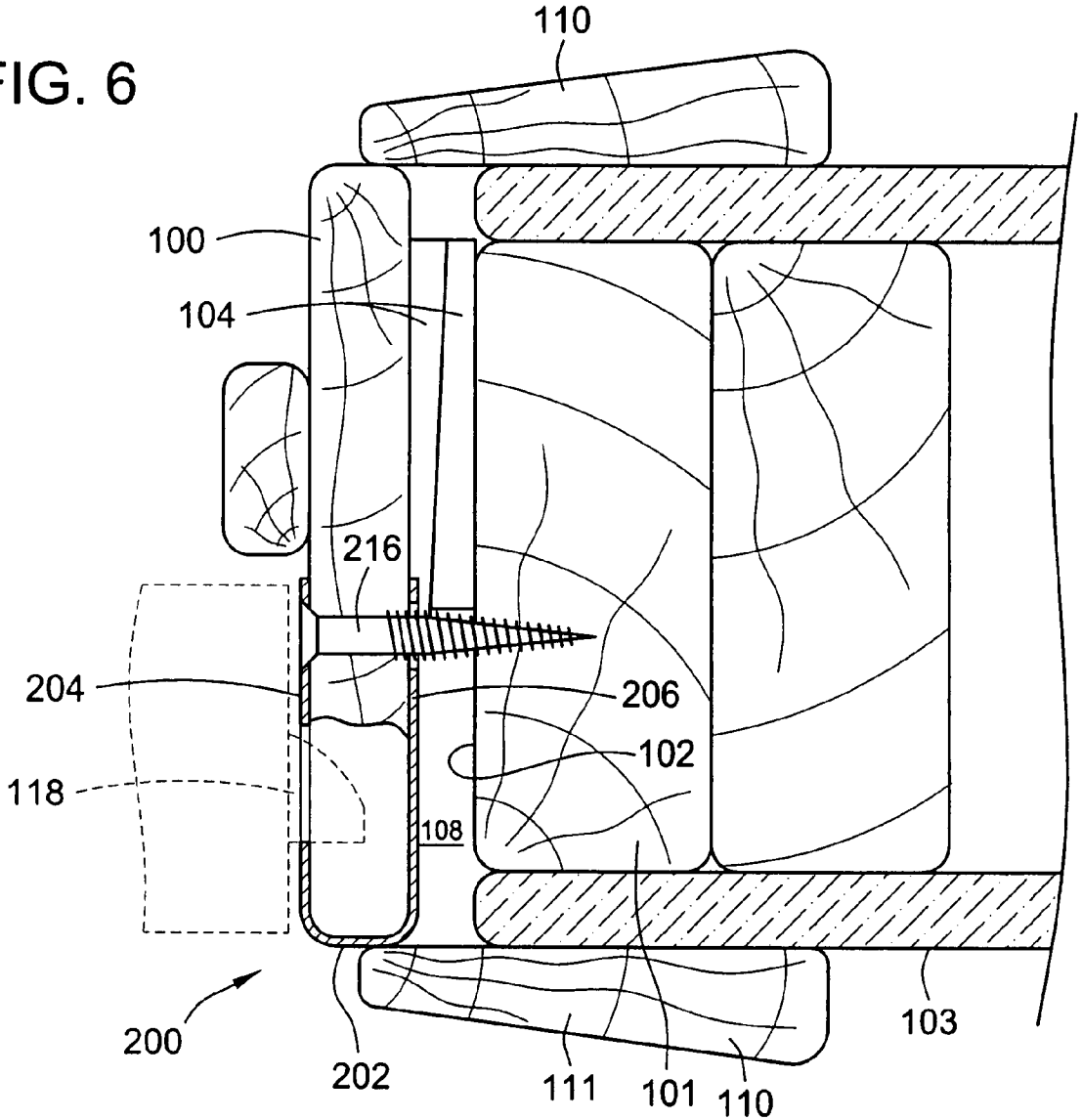

FIG. 4 shows an exemplary embodiment of an apparatus 200, according to the invention, for repairing the jamb of a door, window, or the like, without removal or replacement of the jamb through use of an elongated U-shaped channel 202, adapted to slide over a portion of the jamb 100, in the manner shown in FIG. 5, and be secured in place on the jamb 100 in the manner shown in FIG. 6, for repairing the jamb of a door having had a triangular-shaped chunk thereof broken out through a forced entry, as described above in relation to FIG. 3. The channel 202, of the exemplary embodiment, is formed from a metal, such as galvanized steel. In other embodiments of the invention, however, other types of metals, such as aluminum or brass, or appropriate non-metallic components such as plastic or composite materials may also be used for forming the channel 202.

As shown in FIG. 4, the exemplary embodiment of the U-shaped channel 202 includes a first and a second leg thereof 204, 206, joined by a U-shaped bight 208. The first leg 204 of the channel 202 of the exemplary embodiment includes a first and a second slot therein for receipt of a door latch 118, as shown in FIG. 6. As shown in FIGS. 4 and 6, the first and second legs 204, 206 of the channel 202 of the exemplary embodiment of a door repair apparatus 200 according to the invention, include a plurality of aligned through-holes therein, for passage of screws 216, as shown in FIG. 6, or other types of fasteners, to anchor the channel 202 to the door jamb 100 and/or structural members 103 forming the rough opening 102. The elongated slots 210, 212 in the first leg 204 of the channel 202, of the exemplary embodiment, allow the channel 202 to be moved upward and/or downward along the jamb 100 to be positioned at an optimal location for repairing the damaged jamb 100 and mating with the latch 118, or latches 118 of single or multiple lock sets. By including two slots 210, 212 in the channel 202 repairs can be effectively and efficiently made to jambs for use with doors having both a latch attached directly to the door handle, and a separate latch for deadbolt lock.

Those having skill in the art will recognize, from the descriptions above and an examination of the drawing figures, that the slots 210, 212 in the channel 202 of the exemplary embodiment can be utilized as a strike plate for the latch 118, of the repaired door jamb 100. In some embodiments of the invention, however, the original latch strike plate 120 may be reinstalled, after repair of the jamb 100 with the channel 202, as shown in FIG. 7.

Figure 7:
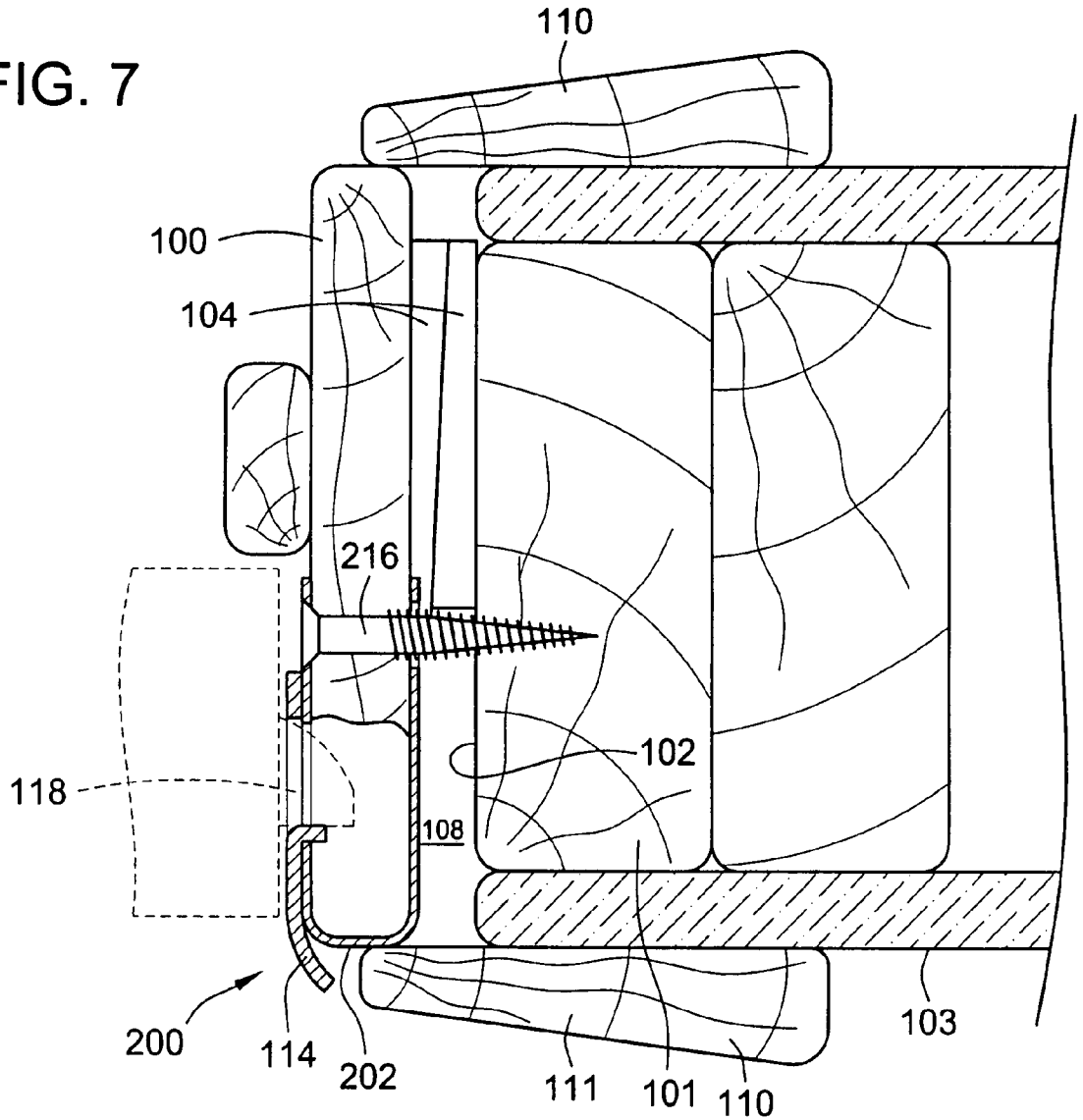

In order to effect a repair of a typical door jamb 100 having a chunk 112 broken out thereof, as shown in FIG. 3, one strip 111 of the door casing 110, as best seen in FIGS. 6 and 7, is removed on the inside of the wall 103 to expose the inner edge of the broken jamb 100, and the gap 108 between the broken section of the jamb 100 and the rough opening 102. Removal of the piece 111 of the casing 110 on the inside surface of the wall 103 is typically accomplished relatively easy, and also typically involves no additional work in repair of the jamb 100, in that this particular piece 111 of the casing 110 is also typically broken when a door is kicked-in.

With the piece 111 of the casing removed, the channel 202 is fitted into place over the inside, broken edge of the jamb 100, with the first leg 204 of the channel facing the door opening, and the second leg 206 of the channel 202 extending into the gap 108 into the jamb 100 and the rough opening 102. The channel 202 is moved up and/or down along the jamb 100 to a position at which the latch or latches 118 will engage the slots 210, 212 in the first leg of the channel 202, and a pair of short screws are driven into the jamb 100 through a pair of holes 215, as shown in FIG. 4, to temporarily secure the channel 202 in place on the jamb 100.

The door may then be closed and opened to check proper alignment of the channel 202 with the latches 118. If necessary, the short screws extending through the pair of holes 215 may be removed and the channel 202 repositioned along the jamb 100 to achieve a proper fit.

When the channel 202 is properly positioned, the channel 202 is permanently secured in place on the jamb 100 by driving the long screws 216, as shown in FIGS. 6 and 7, through the through-holes 214 and into the jamb 100 and the structural members 101 surrounding the rough opening 102. A new piece of casing 111, may then be cut to fit and attached to the inside surface of the wall 103 to complete the repair of the jamb.

Figure 8:
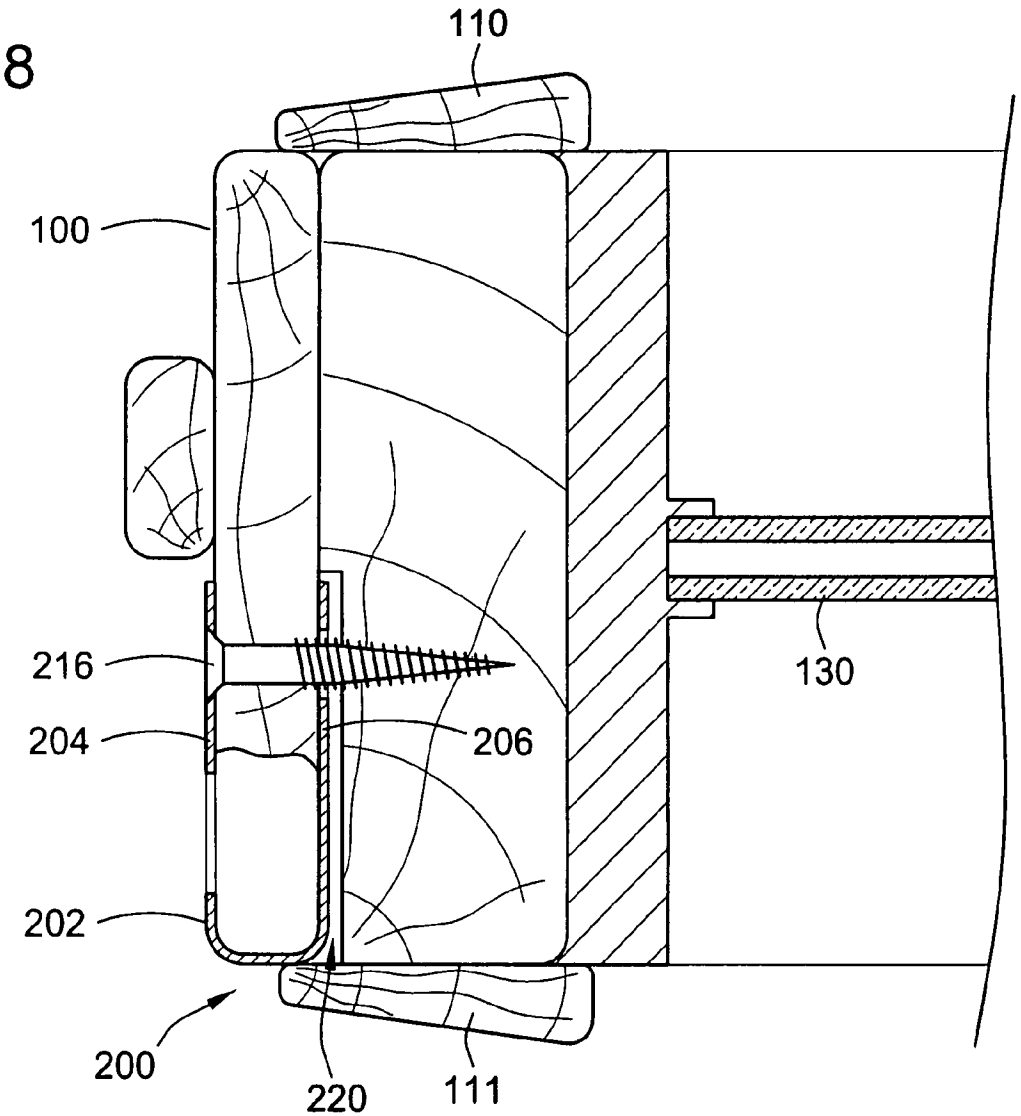
FIG. 8 illustrates the manner in which the invention may be utilized for repairing a damaged jamb in a door and/or window assembly having side-lights.

As shown in FIG. 8, the invention may also be practiced with door or window jambs that include a side-light 130 (i.e. a side window) between the portion of the door jamb 100 forming the opening for the door and the rough opening. In such instances, it may be necessary to cut a curf 220 into the door or window unit, as shown in FIG. 8, for receipt of the second leg 206 of the channel 202 described above.

Figure 9A:
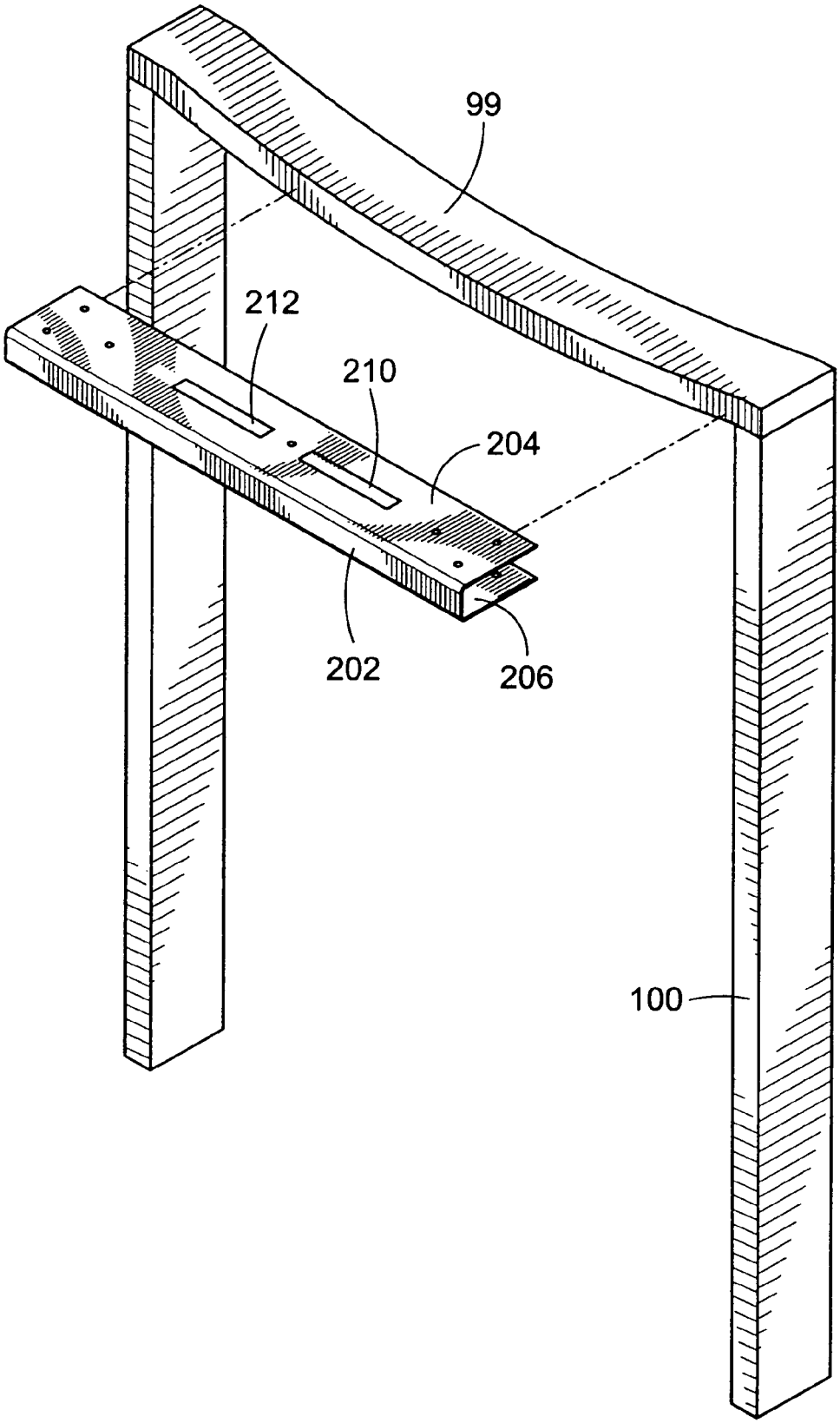
Figure 9B:
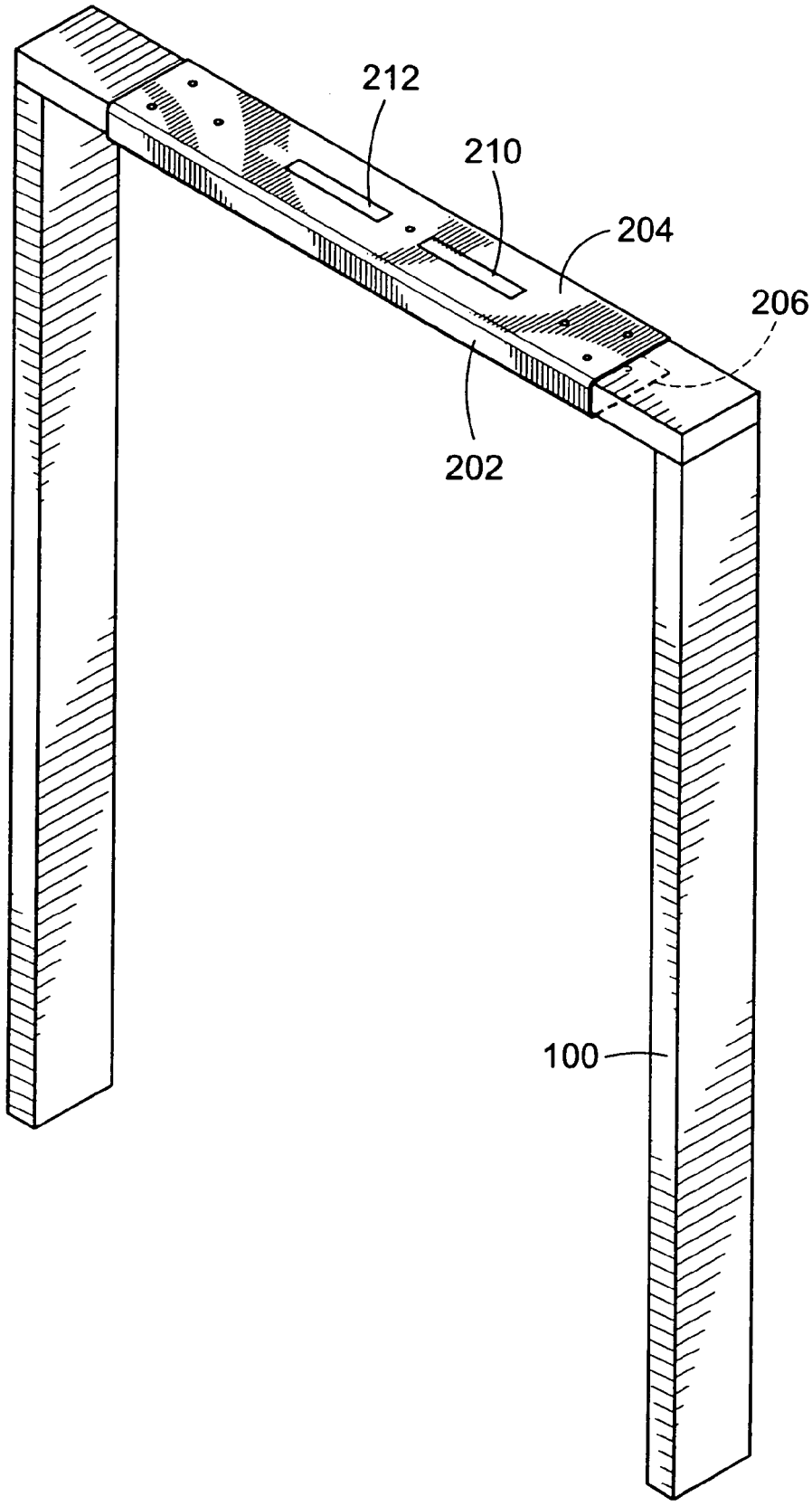

Those having skill in the art will recognize, that although the above disclosure has been directed to repairing a portion of a door jamb 100 having a chunk 112 broken out from around a latch striker plate 114, the invention may also be practiced for repairing sagging portions 99 of a jamb 100 in the manner illustrated in FIGS. 9A and 9B with a channel 202, according to the invention. Where the sagging section 99 does not include latch components, it may be desirable, for aesthetic purposes, to install a channel 202, according to the invention, with the second leg 206 positioned toward the jamb opening, and the first leg 204, having the slots 210, 212 therein positioned in the gap 108 between the jamb 100 and the rough opening 102.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for reinforcing a portion of a jamb, defining an opening for a door or window, or for repairing the portion of the jamb after the portion of the jamb has been damaged, wherein the jamb includes an inside surface thereof adjacent the opening, an outside surface thereof opposite the inside surface and facing supporting structure around the jamb, and an inside edge of the jamb joining the inside and outside surfaces of the jamb, the method comprising, sliding an elongated U-shaped channel, having first and second spaced legs thereof joined by a bight section, over the portion of the jamb in such a manner that the U-shaped channel encompasses the portion of the jamb, and attaching the U-shaped channel to the jamb at one or more locations disposed about the portion of the jamb with one of the legs disposed adjacent the outside surface of the jamb, the other of the legs disposed adjacent the inside surface of the jamb and the U-shaped bight disposed adjacent the inside edge of the jamb;

wherein, the portion of the jamb includes a sagging section thereof, and the method further comprises, at least partially removing the sag from the sagging section through installation of the U-shaped channel.

* * * * *